US008596798B1

(12) United States Patent
VanOsdol

(10) Patent No.: US 8,596,798 B1
(45) Date of Patent: Dec. 3, 2013

(54) TRANSPIRATION PURGING ACCESS PROBE FOR PARTICULATE LADEN OR HAZARDOUS ENVIRONMENTS

(75) Inventor: John G. VanOsdol, Fairmont, WV (US)

(73) Assignee: U.S. Department of Energy, Washington, DC (US)

( * ) Notice: Subject to any disclaimer, the term of this patent is extended or adjusted under 35 U.S.C. 154(b) by 283 days.

(21) Appl. No.: 13/205,021

(22) Filed: Aug. 8, 2011

(51) Int. Cl.
*B60R 1/06* (2006.01)

(52) U.S. Cl.
USPC ..... 359/509; 137/7

(58) Field of Classification Search
USPC ..... 359/507–514; 356/246, 444; 137/7
See application file for complete search history.

(56) References Cited

U.S. PATENT DOCUMENTS 3,021,385 A 2/1962 Summerhayes, Jr. et al.
4,790,653 A * 12/1988 North, Jr. ..... 356/73
4,969,035 A 11/1990 Dawson
4,981,088 A 1/1991 Burris
5,592,217 A 1/1997 Hirvonen et al.
5,831,668 A 11/1998 Hirvonen et al.
6,362,889 B1 3/2002 Mustonen
6,672,725 B1 1/2004 VanOsdol et al.
7,522,834 B2 4/2009 Heaven et al.
2002/0146055 A1 * 10/2002 Pompei ..... 374/125

* cited by examiner

*Primary Examiner* — Stephone B Allen
*Assistant Examiner* — Kimberly N Kakalec
(74) *Attorney, Agent, or Firm* — James B. Potts; Daniel Park; John T. Lucas

(57) ABSTRACT

An access probe for remote-sensing access through a viewing port, viewing volume, and access port into a vessel. The physical boundary around the viewing volume is partially formed by a porous sleeve lying between the viewing volume and a fluid conduit. In a first mode of operation, a fluid supplied to the fluid conduit encounters the porous sleeve and flows through the porous material to maintain the viewing volume free of ash or other matter. When additional fluid force is needed to clear the viewing volume, the pressure of the fluid flow is increased sufficiently to slidably translate the porous sleeve, greatly increasing flow into the viewing volume. The porous sleeve is returned to position by an actuating spring. The access probe thereby provides for alternate modes of operation based on the pressure of an actuating fluid.

19 Claims, 4 Drawing Sheets

TRANSPIRATION PURGING ACCESS PROBE FOR PARTICULATE LADEN OR HAZARDOUS ENVIRONMENTS

GOVERNMENT INTERESTS

The United States Government has rights in this invention pursuant to the employer-employee relationship of the Government to the inventors as U.S. Department of Energy employees and site-support contractors at the National Energy Technology Laboratory.

FIELD OF THE INVENTION

An access probe intended to allow access for a measurement medium into a vessel generating particulate laden or hazardous environments, such as a coal fired boiler with slagging walls. The access probe utilizes a fluid such as air to maintain a positive pressure to minimize material deposition on a viewing lens, and utilizes the fluid as an actuating fluid to reconfigure the internal flow pathway when higher pressure flows are required.

BACKGROUND

Direct observation or viewing by sensors is often used for guidance or control of industrial processes. A significant problem typically encountered in the applications is maintaining clear and uninterrupted transmission through a window or path by which the industrial process is viewed. This problem can be substantial in all environments, however when a sensor is tasked to directly observe a process producing smoke, spatter, powder or other airborne debris, the problems of sensor path and window cleanliness becomes critical. This often results in frequently disrupting the process to clean or change windows, or requires the installation of additional complexities such as window blades, shutters, or other mechanisms. Sensors used for tomography, optical pyrometry, laser absorption spectroscopy, or other remote sensing industrial applications must tolerate the dirty environments associated with dirty, particulate laden environments generated by coal combustion, metal spraying, molten metal atomization, and steel making, among others.

Devices intended to house sensors for use in dirty environments often incorporate an air purge in order to maintain viewing window cleanliness. The air purge acts to maintain a flow across the viewing window in order to mitigate deposition of foreign matter originating with the industrial process. In some cases, higher pressure air may be periodically employed in order to provide a short duration higher energy purge for matter which may gather on or around the viewing window over the course of normal purging. See e.g., U.S. Pat. No. 3,021,385 to Summerhayes Jr., et al.; U.S. Pat. No. 4,981,088 to Burris; U.S. Pat. No. 4,969,035 to Dawson; U.S. Pat. Nos. 5,592,217 and 5,831,668 to Hirvonen et al.; U.S. Pat. No. 6,362,889 to Mustonen; U.S. Pat. No. 6,672,725 to VanOsdol; and U.S. Pat. No. 7,522,834 to Heaven et al., among others. Many of these approaches are additionally intended to maintain a positive pressure flowing from the viewing lens into the vessel conducting the process to be observed. The intent of the positive pressure is to prevent foreign matter from approaching the viewing lens from the vessel environment. Other typical approaches for depositions resistant to normal purge pressures include the use of deslagging blades which are periodically deployed across the viewing lens. See e.g., U.S. Pat. No. 4,759,299 to Kennedy.

Generally speaking, the higher pressure purges are effectuated either through an increase in air supply pressure in order to increase the flow rate through static components, or through the inclusion of additional, dedicated higher pressure pathways. Forcing a higher pressure flow through static components increases parasitic energy requirements, and can increase the necessary bulk of the components in order to withstand repeated exposure to higher design pressures. Similarly, additional, dedicated higher pressure pathways increase the volume footprint of the access probe en toto, in addition to incurring additional probe infrastructure. It would be advantageous to provide an access probe whereby a positive pressure in front of a viewing lens could be increased by utilizing a higher pressure to manipulate the geometric relationship between components, such that a higher pressure pathway could be established without significantly altering the compact nature of the access probe. It would be further advantageous if the probe could act to clear occluding debris from around an access port into the vessel as a result of the component manipulation.

The disclosure relates to an access probe intended to allow access for a measurement medium into a vessel generating particulate laden or hazardous environments, such as a coal fired boiler with slagging walls. The access probe is advantageously utilized for the assistance of passive and active remote sensing of phenomena occurring within the vessel environment utilizing remote sensing instrumentation positioned outside the vessel, via access ports extending through the vessel containment. The measurement medium is typically light and the access is typically provided for the purpose of visual access; however the access probe may be advantageously utilized for the assistance of passive and active remote sensing instrumentation utilizing a variety of measurement mediums such as x-rays, ultrasounds, magnetic resonances, radar, sonar, and the like.

Aspects and advantages of the present disclosure will become better understood with reference to the accompanying description and claims.

SUMMARY

The access probe of this disclosure provides access for a measurement medium into a vessel generating particulate laden or hazardous environments, such as a coal fired boiler with slagging walls. The access probe is advantageously utilized for the assistance of passive and active remote sensing of phenomena occurring within the vessel environment utilizing remote sensing instrumentation positioned outside the vessel, via access ports extending through the vessel containment. The measurement medium is typically light and the access is typically provided for the purpose of visual access; however the access probe may be advantageously utilized for the assistance of passive and active remote sensing instrumentation utilizing a variety of measurement mediums such as x-rays, ultrasounds, magnetic resonances, radar, sonar, and the like.

The access probe provides remote-sensing access into a vessel through a viewing port, along a longitudinal axis L extending through a viewing volume, and through an access port into the vessel. The viewing volume is a three-dimensional space between the viewing port and the access port, and some portion of the physical boundary around the viewing volume is formed by a porous sleeve lying between the viewing volume and a fluid conduit. In a first mode of operation, a fluid such as air supplied to the fluid conduit encounters the porous sleeve and flows through the porous material, into the viewing volume. In this manner, the fluid flow assists in maintaining the viewing volume free of ash or other matter which may generate within the vessel, enter the viewing volume, and subsequently interfere with remote-sensing access through the viewing volume and into the vessel.

When additional fluid force is needed to clear the viewing volume, the pressure of the fluid flow may be increased sufficiently to slidably translate the porous sleeve. This displacement largely eliminates the porous sleeve as a flow restriction between the fluid channel and the viewing volume, and the higher pressure and the flow restriction removal act to greatly increase the flow of fluid into the viewing volume. The increased flow provides for increased positive pressure and expulsion of matter in the viewing volume which may be resistant to a lower pressure fluid flow. Following application of the higher pressure, the pressure of the fluid flow is reduced, and the porous sleeve is returned to a position between the viewing volume and the fluid channel by an actuating spring. The access probe thereby provides for alternate modes of operation based on the pressure of an actuating fluid.

The novel process and principles of operation are further discussed in the following description.

DETAILED DESCRIPTION

Figure 1:
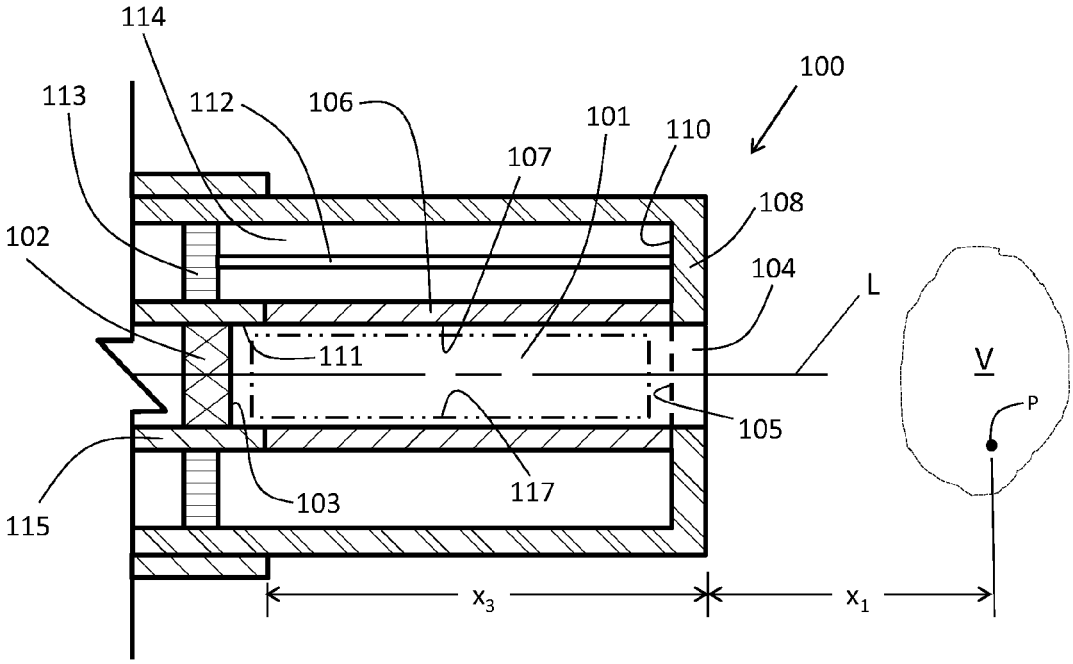
FIG. 1 illustrates an access probe and comprising components in a first mode of operation.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide an access probe providing for alternate modes of operation based on the pressure of an actuating fluid.

The access probe of this disclosure provides access for a measurement medium into a vessel generating particulate laden or hazardous environments, such as a coal fired boiler with slagging walls. The access probe is advantageously utilized for the assistance of passive and active remote sensing of phenomena occurring within the vessel environment utilizing instrumentation positioned outside the vessel, via access ports extending through the vessel containment. The measurement medium is typically light and the access is typically provided for the purpose of visual access; however the access probe may be advantageously utilized for the assistance of passive and active remote sensing instrumentation utilizing a variety of measurement mediums such as x-rays, ultrasounds, magnetic resonances, radar, sonar, and the like.

Generally, the access probe provides remote-sensing access into a vessel through a viewing port, along a longitudinal axis L extending through a viewing volume, and through an access port into the vessel. The viewing volume is a three-dimensional space between the viewing port and the access port, and some portion of the physical boundary around the viewing volume is formed by a porous sleeve. The porous sleeve is a porous material lying between the viewing volume and a fluid conduit, such that a fluid such as air supplied to the fluid conduit encounters the porous sleeve and flows through the porous material, into the viewing volume. In this manner, the fluid flow assists in maintaining the viewing volume free of ash or other matter which may generate within the vessel, enter the viewing volume, and subsequently interfere with remote-sensing access through the viewing volume and into the vessel. When additional fluid force is needed to clear the viewing volume, the pressure of the fluid flow may be increased sufficiently to slidably translate the porous sleeve. This displacement largely eliminates the porous sleeve as a flow restriction between the fluid channel and the viewing volume, and the higher pressure and the flow restriction removal act to greatly increase the flow of fluid into the viewing volume. The increased flow provides for increased positive pressure and expulsion of matter in the viewing volume which may be resistant to a lower pressure fluid flow. Following application of the higher pressure, the pressure of the fluid flow is reduced, and the porous sleeve is returned to a position between the viewing volume and the fluid channel by an actuating spring. The access probe thereby provides for alternate modes of operation based on the pressure of an actuating fluid.

The functional and spatial relationships of components comprising the access probe are illustrated at FIG. 1. FIG. 1 illustrates the access probe generally at 100, and indicates viewing volume 101, where viewing volume 101 is a three-dimensional space within access probe 100. Viewing volume boundary 117 encloses viewing volume 101, where viewing volume boundary 117 is a two-dimensional surface surrounding the three-dimensional viewing volume 101. As described here, the two-dimensional surface comprising viewing volume boundary 117 is not a physical surface within access probe 100, but is rather intended to describe the geometric limits of the three-dimensional viewing volume 101. In the embodiment illustrated at FIG. 1, viewing volume 101 is a cylindrical volume, and viewing volume boundary 117 is the surface of the cylindrical volume. Additionally, although viewing volume boundary 117 is denoted at FIG. 1 with a separation from surrounding components, this is for illustrative purposes only. As will be discussed, in the absence of an actuating pressure, viewing volume boundary 117 is in contact with surrounding components or other defined geometric areas at all points on viewing volume boundary 117.

Further, access probe 100 is comprised of viewing port 102 and access port 104. Longitudinal axis L passes through viewing volume 101 and intersects both viewing port 102 and access port 104, such that during operation a measurement pathway exists from viewing port 102, through viewing volume 101, through access port 104, and into the vessel environment V, generally along longitudinal axis L.

Viewing port 102 is fixably attached to supporting structure 115. Additionally, viewing port 102 is comprised of material transparent to the measurement medium intended to pass through viewing volume 101. For example, when the measurement medium is light, a suitable material comprising viewing port 102 might be an optically transparent glass. The viewing port 102 is further comprised of a viewing port surface 103. The viewing port surface 103 is in contact with viewing volume boundary 117 at all points on viewing port surface 103. Here, "contact" between viewing volume boundary 117 and viewing port surface 103 indicates that viewing volume boundary 117 geometrically extends to the physical boundary of matter comprising viewing port surface 103. Further, longitudinal axis L extending through viewing volume 101 intersects viewing port surface 103.

Similarly, access port 104 is comprised of access port area 105. Access port 104 provides a pathway for a measurement medium such as light to enter viewing volume 101 from the vessel or other environment. Access port area 105 of access port 104 is a two-dimensional area in contact with viewing volume boundary 117 at all points on access port area 105. At FIG. 1, access port 104 is an opening between viewing volume 101 and the vessel environment V, and is formed by surrounding structures comprising access probe 100. Correspondingly, access port 104 provides a spatial rather than physical boundary between viewing volume 101 and the vessel environment V, and as such access port area 105 is a two-dimensional geometric area in space rather than the surface of a physical material. Here, "contact" between viewing volume boundary 117 and access port area 105 indicates that viewing volume boundary 117 geometrically extends to access port area 105, such that access port area 105 is coincident with some portion of viewing volume boundary 117 at all points on access port area 105. Additionally, as stated, the longitudinal axis L intersects access port 104 and access port area 105, so that a measurement medium such as light may travel between viewing port 102 and access port 104 through viewing volume 101.

As described, at FIG. 1 access port 104 is an opening, and access port area 105 is a two-dimensional geometric area in space rather than the surface of a physical material. However, within this disclosure, access port 104 and access port area 105 could be comprised of a physical material, provided that the physical material is transparent to the same measurement medium as the material comprising viewing port 102, and further provided that the physical material is porous to a fluid medium, as will be discussed. In such a case, "contact" between viewing volume boundary 117 and access port area 105 indicates that viewing volume boundary 117 geometrically extends to the physical boundary of the physical matter comprising access port area 105.

Access probe 100 is further comprised of a porous sleeve 106. Porous sleeve 106 is comprised of a material porous to a fluid medium. For example, the fluid medium may be air, and porous sleeve 106 may be comprised of a perforated material, a mesh material, a material woven with organic or metallic fibers, or other materials known in the art which provide a porosity sufficient to allow a flow of air through the material. Porous sleeve 106 is further comprised of porous sleeve surface 107. Porous sleeve surface 107 is a surface on porous sleeve 106 and is in contact with viewing volume boundary 117 at all points on porous sleeve surface 107. Here, "contact" between viewing volume boundary 117 and porous sleeve surface 107 indicates that viewing volume boundary 117 geometrically extends to the physical boundary of matter comprising porous sleeve surface 107. Further, as illustrated at FIG. 1, porous sleeve 106, porous sleeve surface 107, and longitudinal axis L do not intersect.

At FIG. 1, porous sleeve 106 is fixably attached to sliding member 108. Sliding member 108 is located outside of viewing volume 101, and is slidably supported by supporting structure 115. Here, "slidably supported" means that a sufficient force on sliding member 108 in a direction parallel to the longitudinal axis L and toward the vessel environment V generates a sliding translation of sliding member 108 with respect to supporting structure 115, where the sliding translation is in the direction parallel to the longitudinal axis L and toward the vessel environment V. Further, sliding member 108 is comprised of pressure barrier surface 110. Pressure barrier surface 110 is impermeable to the fluid medium which may pass through porous sleeve 106, and pressure barrier surface 110 is oriented with respect to sliding member 108 such that a sufficient force acting normally to pressure barrier 110 generates the sliding translation of sliding member 108. Because porous sleeve 106 is fixably attached to sliding member 108, porous sleeve 106 experiences a similar sliding translation.

An actuating spring 112 is outside viewing volume 101 and is fixably attached to pressure barrier surface 110 at a first end, and fixably attached to spring retaining member 113 at a second end. Spring retaining member 113 is fixably attached to supporting structure 215, and is located relative to pressure barrier surface 110 such that a force acting normally to pressure barrier surface 110 places actuating spring 112 in tension and tends to increase the displacement between the first and second ends of actuating spring 112. Actuating spring 112 is typically a tension coil spring; however within this disclosure actuating spring 112 may be any elastic object having a first end and a second end, where tension of the elastic object causes the elastic object to exert a force proportional to a change in displacement between the first end and the second end.

Access probe 100 is further comprised of fluid conduit 114, located outside of viewing volume 101. Fluid conduit 114 is a three-dimensional space and is enclosed by a fluid conduit boundary surrounding fluid conduit 114. Additionally, pressure barrier surface 110 and porous sleeve 106 comprise at least a portion of the fluid conduit boundary. As a result, an actuating fluid such as air present in fluid conduit 114 encounters both pressure barrier surface 110 and porous sleeve 106.

In a first mode of operation, shown at FIG. 1, optical or other access to vessel environment V is provided through viewing port 102, through viewing volume 101, and finally through access port 104. An actuating fluid such as air is supplied to fluid conduit 114, bounded by the fluid conduit boundary comprised of pressure barrier surface 110 and porous sleeve 106. As a result, the actuating fluid encounters pressure barrier surface 110 and porous sleeve 106, and exerts a force on pressure barrier surface 110. The force on pressure barrier surface 110 places actuating spring 112 in tension; However, in the first mode of operation, the force exerted by the actuating fluid on pressure barrier surface 110 is insufficient to overcome the retaining force generated by actuating spring 112, and sliding member 108 and slidable porous sleeve 106 remain in place, as shown. As a result, the actuating fluid supplied to fluid conduit 114 encounters porous sleeve 106 and flows through porous sleeve 106 into viewing volume 101. The actuating fluid flowing into viewing volume 101 through slidable porous sleeve 106 may generate a positive pressure in viewing volume 101 which acts to remove material deposits within viewing volume 101 and mitigate further deposition in viewing volume 101.

Access probe 100 may be further comprised of viewing volume containment surface 111 in contact with viewing volume boundary 117. In the first mode of operation, where the force exerted on pressure barrier surface 110 is insufficient to generate the sliding translation of sliding member 108 and slidable porous sleeve 106, viewing volume containment surface 111 contacts viewing volume boundary 117 at all points on viewing volume boundary 117 except for those points in contact with viewing port surface 103, access port area 105, and porous sleeve surface 107. Viewing volume boundary 117 is comprised of a surface or surfaces comprised of physical matter, and "contact" between viewing volume boundary 117 and viewing volume containment surface 111 indicates that viewing volume boundary 117 geometrically extends to the physical boundary of matter comprising viewing volume containment surface 111. Viewing volume containment surface 111 may be, for example, a surface of supporting structure 115, as indicated at FIG. 1. Viewing volume containment surface 111 may additionally be comprised of multiple surfaces in contact with viewing volume boundary 117, provided that the multiple surfaces do not fall within viewing port surface 103, access port area 105, or porous sleeve surface 107 as defined herein. As a result, in the first mode of operation, where the force exerted on pressure barrier surface 110 is insufficient to generate the sliding translation of sliding member 108 and slidable porous sleeve 106, viewing volume 101 is fully enclosed by viewing port surface 103, access port area 105, porous sleeve surface 107, and viewing volume containment surface 111.

Figure 2:
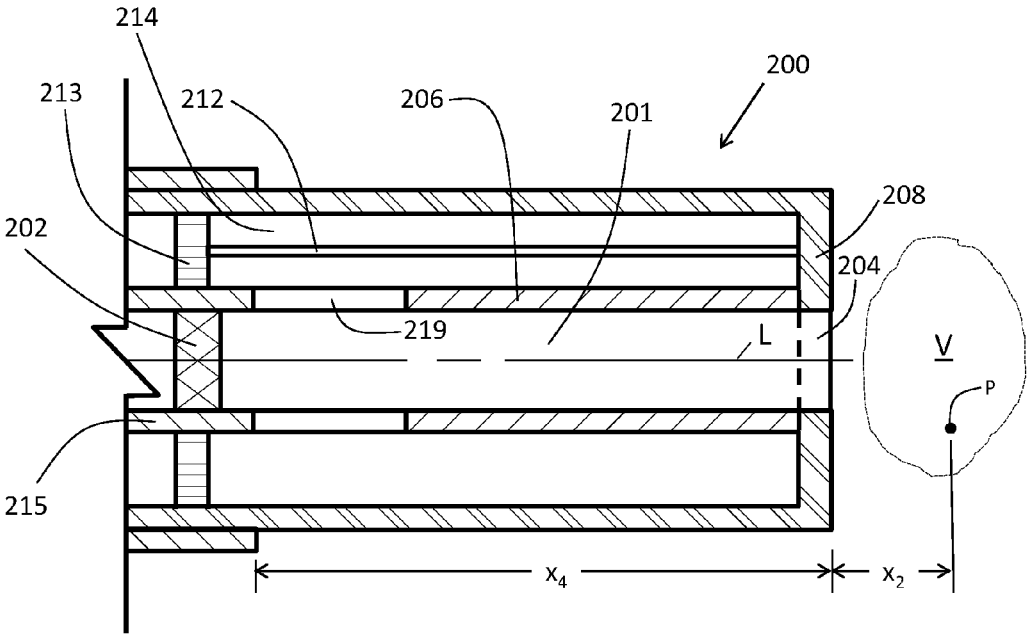
FIG. 2 illustrates the access probe and comprising components in a second mode of operation.

In a second mode of operation illustrated at FIG. 2, the actuating fluid such as air is supplied to fluid conduit 214 at a greater pressure, and exerts a higher pressure on pressure barrier surface 210 and porous sleeve 206. The resulting normal force on pressure barrier surface 210 places actuating spring 212 in greater tension and actuating spring 212 extends, allowing sliding translation of sliding member 208 and porous sleeve 206 in the direction parallel to the longitudinal axis L and toward the vessel environment V. With reference to FIGS. 1 and 2, the sliding translation is illustrated with distance to point P in vessel environment V, where $x_1$ at FIG. 1 is greater than $x_2$ at FIG. 2. The sliding translation further occurs with respect to supporting structure 215 and the components fixably attached, such as spring retaining member 213, and viewing port 202, as indicated by $x_3$ and $x_4$ at FIGS. 1 and 2, where $x_4>x_3$. The sliding translation continues until the increased spring displacement generates counterforce on pressure barrier surface 210 equivalent to the normal force generated by the actuating fluid.

The sliding translation of porous sleeve 206 creates flow opening 219 between fluid conduit 214 and viewing volume 201, and provides an alternate flowpath of greatly reduced resistance around porous sleeve 206. The greatly reduced flow resistance through flow opening 219 couples with the higher pressure of the actuating fluid to greatly increase the volume of flow and positive pressure generated in viewing volume 201. The specific mode of operation of access probe 200 may be cycled between the first and second modes over the course of normal operation. In an embodiment, the sliding translation generated through the normal force on the pressure barrier surface further provides a ram action for the removal of debris such as slag which may be occluding the access port from a position outside of the access probe.

Note that in the embodiment illustrated at FIG. 2, the location of access port 204 displaces in conjunction with sliding member 208 and porous sleeve 206, however this is not a limitation within this disclosure. Access port 204 could be formed and supported by, for example, supporting structure 215, such that the sliding translation of sliding member 208 and porous sleeve 206 does not alter the displacement between, for example, access port 204 and viewing port 202.

Figure 3:
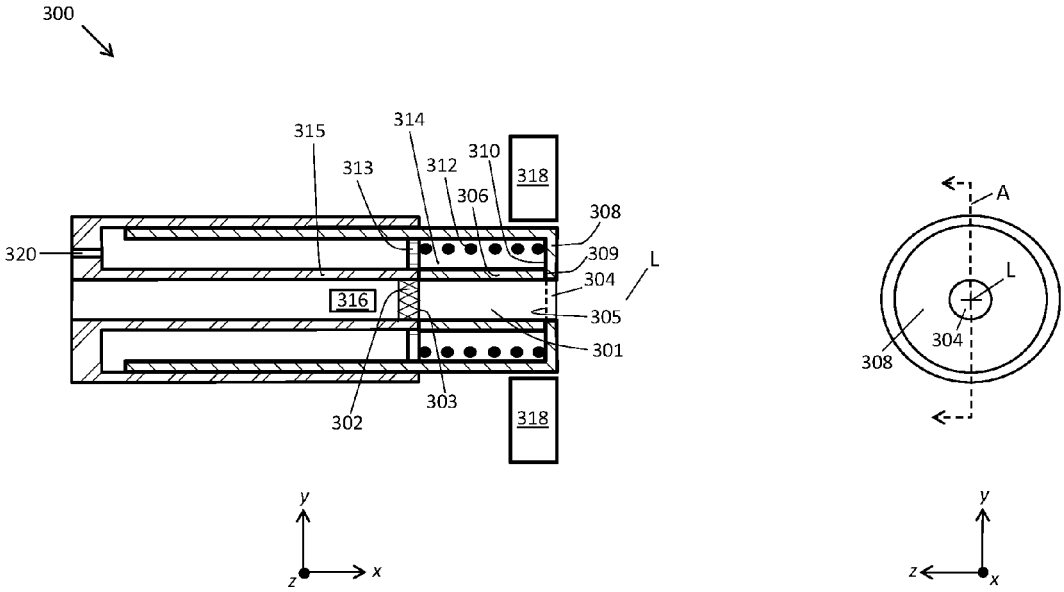
FIG. 3 illustrates a further embodiment of the access probe and comprising components in a first mode of operation.

A further embodiment is illustrated at FIG. 3 in two views and generally indicated at 300, where coordinate axes indicate the perspective of the respective views and cross-section axis A passes through longitudinal axis L. Access probe 300 is generally a cylindrically shaped probe providing measurement access for sensing equipment 316 through viewing port 302, viewing volume 301, and access port 304, and generally along longitudinal axis L. Access probe 300 is inserted into a viewing access provided through vessel walls 318, as illustrated. An exemplary application of access probe 300 might be the provision of visual access into a slagging coal combustion vessel for the purpose of $O_2$ concentration diagnostics via tomography, as is known in the art.

Access probe 300 is comprised of viewing volume 301, where viewing volume 301 is a cylinder having a cylindrical axis coincident with longitudinal axis L. As before, viewing volume 301 is enclosed by a viewing volume boundary (not shown) and surrounded by viewing port surface 303, porous sleeve surface 307, and access port area 305. Porous sleeve surface 307 is the inner surface of annular shaped porous sleeve 306, which circumferentially encloses at least some portion of the cylindrically shaped viewing volume 301.

Sliding member 308 is an annular member symmetric about longitudinal axis L, and is fixably attached to porous sleeve 306 at attachment surface 309. Sliding member 308 further provides pressure barrier surface 310. At FIG. 3, pressure barrier surface 310 is an annular surface having inner and outer radii originating at longitudinal axis L. Sliding member 308 further extends as an annular component from pressure barrier surface 310 to slidably mate with a surface of supporting structure 315. As illustrated, fluid conduit 314 is formed as an annular passage bounded partially by pressure barrier surface 310 and annular shaped porous sleeve 306, and the remainder of sliding member 308.

Actuating spring 312 is a tension coil spring arranged within the annular passage of fluid conduit 314 such that the coils of actuating spring 312 surround porous sleeve 306 and viewing volume 301. As before, actuating spring 312 is fixably attached to pressure barrier surface 310 at a first end and spring retaining member 313 at a second end. Spring retaining member 313 is an annular member fixably attached to supporting structure 315. Further, in the embodiment depicted, spring retaining member 313 is permeable to an air flow. For example, spring retaining member 313 may be an annular member having inner and outer radii, with flow passages extending through the annular member between the inner and outer radii in a circle of centers or some other geometric arrangement.

In operation, an actuating fluid of air at a first pressure is provided via fluid duct 320 to access probe 300. The actuating fluid encounters and passes through spring retaining member 313, entering the annular passage of fluid conduit 314 and encountering pressure barrier surface 310 and porous sleeve 306, and exerting a force on pressure barrier surface 310. At the first pressure, the total pressure of the actuating fluid impacting pressure barrier surface 310 is insufficient to overcome the retaining force generated by actuating spring 312, and porous sleeve 306 remains in place. As a result, the actuating fluid flows through porous sleeve 306 into viewing volume 301, generating a positive pressure which acts to remove material deposits and mitigate further deposition in viewing volume 301. When additional positive pressure within viewing volume 301 is desired for more energetic deposition removal, or when ram action may be desired to clear material which may be occluding access port 304—for example, a slag buildup on the vessel walls 318 of a slagging coal combustion vessel—the pressure of the air flow provided via fluid duct 320 may be increased to a second higher pressure.

Figure 4:
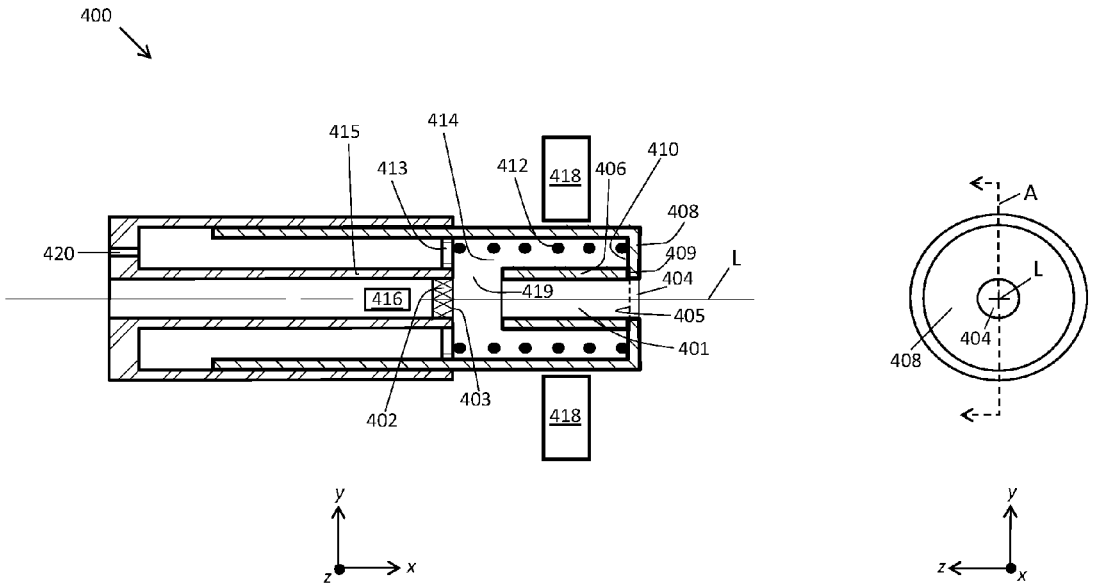
FIG. 4 illustrates a further embodiment of the access probe and comprising components in a second mode of operation.

At the second higher pressure, the components function as earlier described. As illustrated at FIG. 4, when the actuating fluid supplied to fluid conduit 414 via fluid duct 420 exerts a higher pressure on pressure barrier surface 410 and porous sleeve 406, the resulting normal force on pressure barrier surface 410 extends actuating spring 412 and generates sliding translation of sliding member 408 and porous sleeve 406 in a direction generally parallel to longitudinal axis L. The sliding translation continues until the increased spring displacement generates counterforce on pressure barrier surface 410 equivalent to the normal force generated by the actuating fluid, and provides an alternate flowpath of greatly reduced resistance through flow opening 419, around porous sleeve 406, and into viewing volume 401. Further, in this embodiment, the sliding translation provides a ram action for the removal of debris such as slag which may be occluding the access port from a position outside of the access probe, as indicated by the relative positions between, for example, sliding member 308 and vessel walls 318 at FIG. 3 and sliding member 408 and vessel walls 418 at FIG. 4.

In the embodiment at FIG. 3, porous sleeve 306 is arranged relative to viewing port 302 and viewing port surface 303 such that when air flow is supplied at the first pressure, the air flow proceeds through the annular porous sleeve 306 and flows radially inward and then axially away from viewing port surface 303. This pattern of flow prevents any dust or other contaminants which might enter viewing volume 301 from the vessel from depositing on viewing port surface 303. See U.S. Pat. No. 6,672,725 to VanOsdol. Similarly, when sliding translation of slidable porous sleeve 306 occurs, the higher energy flow bypassing porous sleeve 306 follows a similar geometry.

The components of the access probe described here may be constructed from any suitable inert material, for example, stainless steel. The actuating fluid may be either a liquid or a gas, and the temperature, pressure, and flow rate of the actuating fluid may be any condition tolerable within the resulting material constraints of the access probe, and may further be varied when conditions within a vessel serviced by the access probe are varying. The geometric dimensions of the access probe may vary and be application specific, provided the dimensions are sufficient to enable the functional and spatial relationships of the components disclosed herein.

Thus, the disclosure provides an access probe for a measurement medium into a vessel generating particulate laden or hazardous environments, such as a coal fired boiler with slagging walls. The access probe is advantageously utilized for the assistance of passive and active remote sensing of phenomena occurring within the vessel environment utilizing remote sensing instrumentation positioned outside the vessel, via access ports extending through the vessel containment. The access probe provides remote-sensing access into a vessel through a viewing port, along a longitudinal axis L extending through a viewing volume, and through an access port into the vessel. A porous sleeve between a fluid conduit and the viewing volume allows for generation of a positive pressure in the viewing volume, and when additional fluid force is needed, the pressure of the fluid flow may be increased sufficiently to slidably translate the porous sleeve. The sliding displacement largely eliminates the porous sleeve as a flow restriction between the fluid channel and the viewing volume, and the higher pressure and the flow restriction removal act to greatly increase the flow of fluid into the viewing volume. Following application of the higher pressure, the pressure of the fluid flow is reduced, and the porous sleeve is returned to a position between the viewing volume and the fluid channel by an actuating spring. The access probe may be advantageously utilized for the assistance of passive and active remote sensing instrumentation utilizing a variety of measurement mediums such as light, x-rays, ultrasounds, magnetic resonances, radar, sonar, and the like.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. An apparatus for providing access of a measurement medium to a vessel comprising:

a viewing volume, where the viewing volume is a three-dimensional space having a longitudinal axis L extending through the viewing volume, and where the viewing volume has a viewing volume boundary, where the viewing volume boundary is a two-dimensional surface area surrounding the viewing volume;

a viewing port, where the viewing port is transparent to the measurement medium, and where the viewing port has a viewing port surface, where the viewing port surface is in contact with the viewing volume boundary at all points on the viewing port surface, and where the longitudinal axis intersects the viewing port surface;

a supporting structure located outside of the viewing volume, where the supporting structure is fixably attached to the viewing port;

an access port area, where the access port area is transparent to the measurement medium, and where the access port area is in contact with the viewing volume boundary at all points on the access port area, and where the longitudinal axis intersects the access port area;

a porous sleeve, where the porous sleeve is porous to a fluid medium, and where the porous sleeve has a porous sleeve surface, where the porous sleeve surface is in contact with the viewing volume boundary at all points on the porous sleeve surface, and where the porous sleeve surface and the longitudinal axis L do not geometrically intersect;

a sliding member having a pressure barrier surface and fixably attached to the porous sleeve, where the sliding member is outside of the viewing volume, and where the sliding member is slidably supported by the supporting structure, and where the pressure barrier surface is oriented with respect to the sliding member such that a force on the pressure barrier surface acting normally to the pressure barrier surface generates a sliding translation of the sliding member;

an actuating spring having a first spring end, a second spring end, and a spring displacement between the first spring end and the second spring end, where the actuating spring is fixably attached to the pressure barrier surface at the first spring end, and where the actuating spring is outside of the viewing volume;

a spring retaining member, where the spring retaining member is outside of the viewing volume, and where the spring retaining member is fixably attached to the supporting structure, and where the spring retaining member is fixably attached to the second spring end, and where the spring retaining member is located relative to the first spring end such that the sliding translation of the sliding member increases the spring displacement, such that the actuating spring experiences increased tensile force as a result of the sliding translation; and a fluid conduit located outside of the viewing volume, where the fluid conduit has a fluid conduit boundary surrounding the fluid conduit, and where the pressure barrier surface and the porous sleeve comprise at least a portion of the fluid conduit boundary, such that an actuating fluid flow in the fluid conduit encounters the pressure barrier surface and the porous sleeve, and such that the actuating fluid flow may generate force on the pressure barrier surface acting normally to the pressure barrier surface, generating the sliding translation of the sliding member and generating the increased tensile force in the actuating spring.

2. The apparatus of claim 1 where the viewing volume is symmetric about the longitudinal axis.

3. The apparatus of claim 2 where the sliding translation of the sliding member occurs in a direction parallel to the longitudinal axis L and in a direction from the viewing port to the access port area.

4. The apparatus of claim 3 where the porous sleeve circumferentially surrounds at least a portion of the viewing volume boundary.

5. The apparatus of claim 4 where the fluid conduit circumferentially surrounds the slidable porous sleeve.

6. The apparatus of claim 5 where the fluid conduit has a first fluid end and a second fluid end, and where the pressure barrier surface is in contact with the first fluid end and the spring retaining member is in contact with the second fluid end, such that the actuating spring is located within the fluid conduit boundary.

7. The apparatus of claim 6 where the fluid conduit is in fluid communication with a source of pressurized fluid.

8. The apparatus of claim 5 where the viewing volume is a cylinder, and where the porous sleeve is an annulus circumferentially surrounding the at least a portion of the viewing volume boundary, and where the fluid conduit is an annulus circumferentially surrounding the porous sleeve, and where the actuating spring is a tension coil sprint comprised of a plurality of coils, where the plurality of coils circumferentially surrounds the porous sleeve.

9. An apparatus for providing access of a measurement medium to a vessel comprising:

a viewing volume, where the viewing volume is a three-dimensional space having a longitudinal axis L extending through the viewing volume, and where the viewing volume is symmetric about the longitudinal axis L, and where the viewing volume has a viewing volume boundary, where the viewing volume boundary is a two-dimensional surface area surrounding the viewing volume;

a viewing port, where the viewing port is transparent to the measurement medium, and where the viewing port has a viewing port surface, where the longitudinal axis L intersects the viewing port surface, and where the viewing port surface is in contact with the viewing volume boundary at all points on the viewing port surface;

a supporting structure located outside of the viewing volume, where the supporting structure is fixably attached to the viewing port;

an access port area, where the access port area is transparent to the measurement medium, and where the longitudinal axis L intersects the access port area, and where the access port area is in contact with the viewing volume boundary at all points on the access port area;

a porous sleeve, where the porous sleeve is porous to a fluid medium, where the porous sleeve circumferentially surrounds at least a portion of the viewing volume boundary, and where the porous sleeve has a porous sleeve surface, where the porous sleeve surface is in contact with the viewing volume boundary at all points on the porous sleeve surface, and where the porous sleeve surface and the longitudinal axis L do not intersect;

a sliding member having a pressure barrier surface and fixably attached to the porous sleeve, where the sliding member is outside of the viewing volume, and where the sliding member is slidably supported by the supporting structure, and where the pressure barrier surface is oriented with respect to the sliding member such that a force on the pressure barrier surface acting normally to the pressure barrier surface generates a sliding translation of the sliding member, where the sliding translation of the sliding member occurs in a direction parallel to the longitudinal axis L and in a direction from the viewing port to the access port area;

an actuating spring having a first spring end, a second spring end, and a spring displacement between the first spring end and the second spring end, where the actuating spring is fixably attached to the pressure barrier surface at the first spring end, and where the actuating spring is outside of the viewing volume;

a spring retaining member, where the spring retaining member is outside of the viewing volume, and where the spring retaining member is fixably attached to the supporting structure, and where the spring retaining member is fixably attached to the second spring end, and where the spring retaining member is located relative to the first spring end such that the sliding translation of the sliding member increases the spring displacement, such that the actuating spring experiences increased tensile force as a result of the sliding translation; and a fluid conduit located outside of the viewing volume, where the fluid conduit has a fluid conduit boundary surrounding the fluid conduit, and where the pressure barrier surface and the porous sleeve comprise at least a portion of the fluid conduit boundary, such that an actuating fluid flow in the fluid conduit encounters the pressure barrier surface and the porous sleeve, and such that the actuating fluid flow may generate force on the pressure barrier surface acting normally to the pressure barrier surface, generating the sliding translation of the sliding member and generating the increased tensile force in the actuating spring.

10. The apparatus of claim 9 where the fluid conduit circumferentially surrounds the porous sleeve.

11. The apparatus of claim 10 where the fluid conduit has a first fluid end and a second fluid end, and where the pressure barrier surface is in contact with the first fluid end and the spring retaining member is in contact with the second fluid end, such that the actuating spring is located within the fluid conduit boundary.

12. The apparatus of claim 10 where the actuating spring is a tension coil spring comprised of a plurality of coils, where the plurality of coils circumferentially surrounds the porous sleeve.

13. The apparatus of claim 12 where a portion of the sliding member is symmetric about the longitudinal axis L and where the portion of the sliding member circumferentially surrounds at least a portion of the fluid conduit, and where one end of the portion of the sliding member is slidably supported by the supporting structure.

14. The apparatus of claim 13 where the spring retaining member is symmetric about the longitudinal axis L and where the spring retaining member is comprised of flow passages in fluid communication with the fluid conduit.

15. The apparatus of claim 14 where the flow passages are further in fluid communication with a source of pressurized fluid.

16. The apparatus of claim 14 where the viewing volume is a cylinder, and where the porous sleeve is a first annulus having an inner radii and an outer radii and circumferentially surrounding the at least a portion of the viewing volume boundary, and where the porous sleeve surface is an interior surface at the inner radii of the first annulus, and where the portion of the sliding member is a second annulus circumferentially surrounding the at least a portion of the fluid conduit, and where the fluid conduit is a third annulus circumferentially surrounding the porous sleeve.

17. An apparatus for providing access of a measurement medium to a vessel comprising:

a viewing volume, where the viewing volume is a three-dimensional cylindrical space having a longitudinal axis L extending through the viewing volume, and where the viewing volume is symmetric about the longitudinal axis L, and where the viewing volume has a viewing volume boundary, where the viewing volume boundary is a two-dimensional surface area surrounding the viewing volume;

a viewing port, where the viewing port is transparent to the measurement medium, and where the viewing port has a viewing port surface, where the longitudinal axis L intersects the viewing port surface, and where the viewing port surface is in contact with the viewing volume boundary at all points on the viewing port surface;

a supporting structure located outside of the viewing volume, where the supporting structure is fixably attached to the viewing port;

an access port area, where the access port area is transparent to the measurement medium, and where the longitudinal axis L intersects the access port area, and where the access port area is in contact with the viewing volume boundary at all points on the access port area;

a porous sleeve, where the porous sleeve is porous to a fluid medium, and where the porous sleeve is a first annulus having an porous sleeve inner radii and a porous sleeve outer radii and circumferentially surrounding at least a portion of the viewing volume boundary, and where the porous sleeve has a porous sleeve surface, where the porous sleeve surface is an interior surface at the porous sleeve inner radii of the first annulus, and where the porous sleeve surface is in contact with the viewing volume boundary at all points on the porous sleeve surface, and where the porous sleeve surface and the longitudinal axis L do not intersect;

a sliding member having a pressure barrier surface and fixably attached to the porous sleeve, where the sliding member is outside of the viewing volume, and where the sliding member is slidably supported by the supporting structure, and where the pressure barrier surface is oriented with respect to the sliding member such that a force on the pressure barrier surface acting normally to the pressure barrier surface generates a sliding translation of the sliding member, where the sliding translation of the sliding member occurs in a direction parallel to the longitudinal axis L and in a direction from the viewing port to the access port area, where a portion of the sliding member is a second annulus having a sliding member inner radii and a sliding member outer radii, and where the supporting structure slidably supports the sliding member by circumferentially surrounding the sliding member outer radii over a length of the portion of the sliding member;

an actuating spring, where the actuating spring is a tension coil spring comprised of a plurality of coils, and where the actuating spring has a first spring end, a second spring end, and a spring displacement between the first spring end and the second spring end, where the actuating spring is fixably attached to the pressure barrier surface at the first spring end, and where the actuating spring is outside of the viewing volume, and where the plurality of coils circumferentially surrounds the porous sleeve outer radii of the porous sleeve;

a fluid conduit located outside of the viewing volume, where some portion of the fluid conduit is located between the porous sleeve outer radii and the sliding member inner radii, and where the fluid conduit has a fluid conduit boundary, where the pressure barrier surface and the porous sleeve comprise at least a portion of the fluid conduit boundary, such that an actuating fluid flow in the fluid conduit encounters the pressure barrier surface and the porous sleeve, and such that the actuating fluid flow may generate force on the pressure barrier surface acting normally to the pressure barrier surface, generating the sliding translation of the sliding member; and a spring retaining member, where the spring retaining member is outside of the viewing volume, and where the spring retaining member is symmetrical about the longitudinal axis L, and where the spring retaining member is comprised of flow passages in fluid communication with the fluid conduit, and where the spring retaining member is fixably attached to the supporting structure, and where the spring retaining member is fixably attached to the second spring end, and where the spring retaining member is located relative to the first spring end such that the sliding translation of the sliding member increases the spring displacement, such that the actuating spring experiences increased tensile force as a result of the sliding translation.

18. The apparatus of claim 17 where the fluid conduit has a first fluid end and a second fluid end, and where the pressure barrier surface is in contact with the first fluid end and the spring retaining member is in contact with the second fluid end, such that the actuating spring is located within the fluid conduit boundary.

19. The apparatus of claim 18 where the flow passages are further in fluid communication with a source of pressurized fluid.

* * * * *